US005613460A

United States Patent [19]

Stallard, III

[11] Patent Number: 5,613,460

[45] Date of Patent: Mar. 25, 1997

[54] SUBMERSIBLE VESSEL EXTERNAL LOAD MOUNTING SYSTEM

[75] Inventor: Clinton W. Stallard, III, Hampton, Va.

[73] Assignee: Newport News Shipbuilding and Dry Dock Company, Newport News, Va.

[21] Appl. No.: 642,123

[22] Filed: May 2, 1996

Related U.S. Application Data

[63] Continuation of Ser. No. 298,858, Aug. 31, 1994, abandoned.

[51] Int. Cl.[6] ..... B62G 8/00

[52] U.S. Cl. ..... 114/312; 114/321; 114/357

[58] Field of Search ..... 14/312, 313, 316, 14/317, 318, 319, 321, 341, 357, 238, 123

[56] References Cited

U.S. PATENT DOCUMENTS

| | | | |
|---|---|---|---|
| 1,370,467 | 3/1921 | McMahon | 114/318 |
| 2,735,391 | 2/1956 | Buschers | 114/321 |
| 3,368,510 | 2/1968 | Humphrey | 114/317 |
| 3,598,275 | 8/1971 | Francois | 114/341 |
| 3,897,743 | 8/1975 | Schoonman | 114/321 |
| 3,969,977 | 7/1976 | Opdahl et al. | 114/319 |
| 4,625,674 | 12/1986 | Covington | 114/123 |
| 4,807,556 | 2/1989 | Hillier | 114/123 |

*Primary Examiner*—Stephen Avila
*Attorney, Agent, or Firm*—Lalos & Keegan

[57] ABSTRACT

An external storage system for a submersible vessel, e.g. a submarine, includes an outer skin formed as a fairing member of the vessel. The internal volume of the external storage system, bounded by the outer skin and the hull of the vessel is occupied by support members appropriate for the selected load and syntactic foam. The syntactic foam provides structural support for the outer skin and load support members, an additional attachment bond between the hull, skin, and load support members, and the buoyancy required to compensate for the additional weight of the external load. The syntactic foam also provides certain acoustic advantages.

18 Claims, 2 Drawing Sheets

SUBMERSIBLE VESSEL EXTERNAL LOAD MOUNTING SYSTEM

This is a continuation of application Ser. No. 08/298,858 filed on Aug. 31, 1994 now abandoned.

BACKGROUND OF THE INVENTION

The present invention is related to methods and apparatus for mounting external loads to a submersible vessel, for example, external weapons launch systems for submarines.

Generally, loads such as weapons are stored and carried internally within the hull of the submersible vessel. Internal storage has a disadvantage in that weight limits and stability requirements restrict the number, size and total weight of loads/weapons that can be carried aboard. Further, the internal volume available within the hull, after fitting in all other required systems, necessarily restricts the size of the load or number of weapons that can be accommodated.

The total weight restriction of the loads or weapons can be exceeded only by increasing the size of the submersible vessel to increase the buoyancy; otherwise, no additional water is displaced to provide the buoyancy necessary to offset the additional weight. This is a significant disadvantage, especially for submarines. Large submarines may not always be desirable because weapon requirements may lessens making such a large submarine obsolete. Large weapon requirements may in fact be limited to a single mission or small number of missions, not significant enough to justify a major redesign of existing hulls or a new design for a new class of submarines.

SUMMARY OF THE INVENTION

The present invention overcomes the disadvantages of the prior art by providing a method and apparatus for externally mounting loads or weapons systems to existing vessels, which maintains or improves the hydrostatic characteristics of the submersible vessel without an unacceptable negative impact on the vessel's hydrodynamics. The external storage structure is mounted on the outside of the vessel hull, preferably on both sides of the vessel hull symmetrically disposed about the vessel's longitudinal axis. Such add-on structure provides the necessary water displacement and buoyancy to accommodate the weight of the additional load. The external surface of the structure is designed to minimize any negative impact on the hydrodynamic characteristics of the vessel, and preferably includes fore and aft fairing members.

The internal volume of the add-on structure is occupied by support members appropriate for the selected load, for example weapon storage tubes and launch apparatus, and syntactic foam. The syntactic foam, in its liquid state, is poured around the internal support members and next to the vessel hull within an exterior form or mold, which may be bonded in place or removed after the syntactic foam is cured. If the exterior form or mold is removed, the syntactic foam will form the exterior boundary or skin of the add-on structure. In either case, the exterior boundary of the add-on structure is configured as a fairing member of the vessel to minimize any negative hydrodynamic implications. In certain applications, the internal support members for the load may be eliminated and load cavities may be formed with removable molds over which the syntactic foam is poured in its liquid state. Once the foam is cured, the internal molds can be removed and the add-on storage structure will be formed entirely or at least largely of syntactic foam.

DETAILED DESCRIPTION

Figure 1:
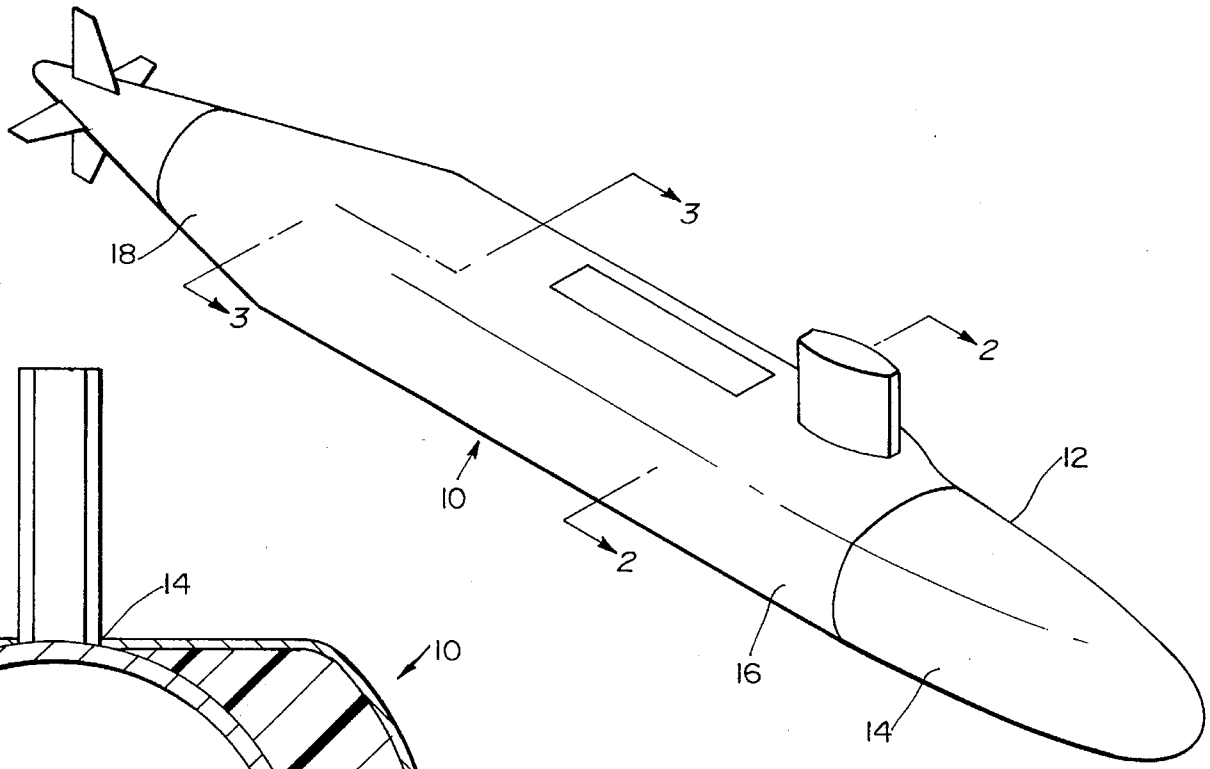
FIG. 1 is a perspective view of a vessel with the externally mounted storage system of the present invention attached thereto.

As shown in FIG. 1, the externally mounted storage structure 10 of the present invention is attached to hull 12 of submersible vessel 14 (e.g. a submarine). The external surface of structure 10 is configured to minimize any negative hydrodynamic impact on the operating characteristics of submersible vessel 14. To this end, structure 10 is formed with forward and aft fairing members 16 and 18, respectively.

Figure 2:
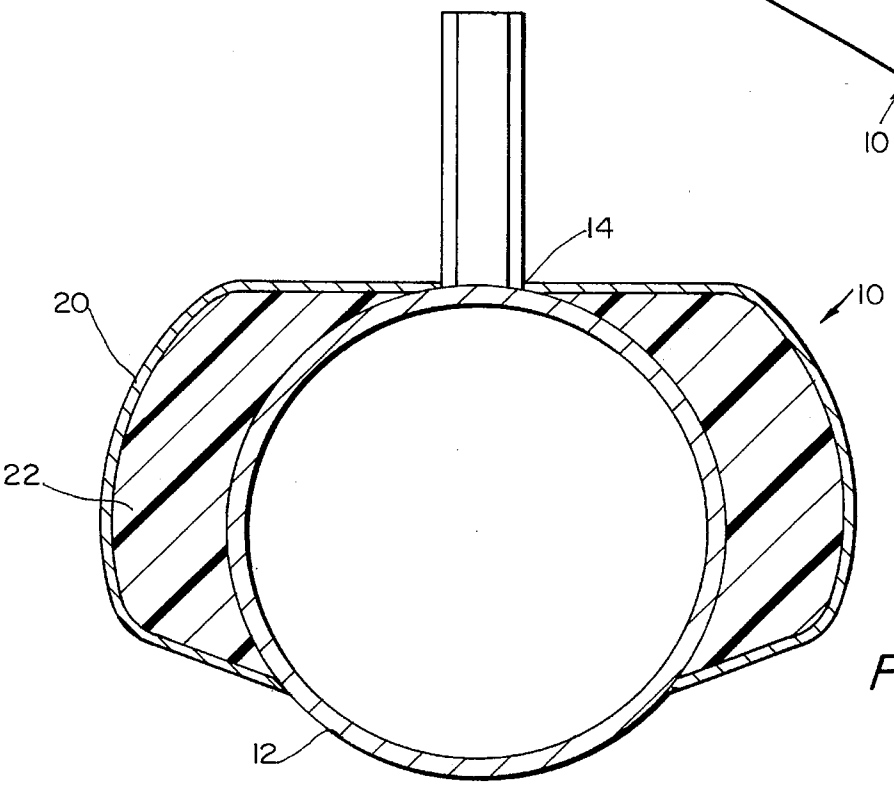
FIG. 2 is a partial cross-sectional view taken along the line 2—2 of FIG. 1.

In forming structure 10, an external form or mold 20 is attached to the outside surface of hull 12 (FIG. 2). This form or mold may be of any suitable material and may be attached in any suitable manner, as dictated by the particular application. In the embodiment of the present invention wherein form 20 remains as the outside surface or skin of structure 10, form 20 should be a material of suitable strength and shock resistance. For example, in an embodiment wherein vessel 14 is a submarine, form 20 would preferably be a steel skin welded or otherwise attached to hull 12. As shown in FIG. 2, structure 10 is preferably formed symmetrically on both sides of vessel 14 about its longitudinal axis, and thus evenly balanced.

The external form 20 is filled, at least partially, with a syntactic foam 22. As will be discussed further hereinafter, the balance of the internal space bounded by hull 12 and form 20 will be occupied by support structure. In the example of a submarine, such support may include missile and launcher support. Form 20 may either be bonded in place to form the exterior skin of structure 10 or, if treated with a mold release agent, can be removed after the syntactic foam 22 is cured.

In the embodiment of the present invention wherein form 20 is removed and the syntactic foam 20 forms the outside skin, a urethane syntactic is preferred. Urethane syntactic materials are less sensitive to shock and extremely tough (rather than brittle) as compared with an epoxy resin based syntactic material.

The syntactic material is generally composed of a liquid resin system which may be of various chemical structures and may be pliable or rigid when cured. As the resin system is mixed, it is filled with microspheres or macrospheres which are small or large rigid hollow spheres which do not deform under hydrostatic pressure. Thus, the syntactic material is a filled cured resin which is low in density due to the fact that the microspheres or macrospheres used as filler are hollow and therefore very low density. These hollow spheres used as fillers are currently made from glass, ceramics, fly-ash, graphite, plastics and other materials with high crush strength. Resistance to deformation under hydrostatic pressure and resistance to migration of water into the spheres are the primary requirements of the microspheres and macrospheres in the present invention.

The syntactic material, when cured, is a tough and non-brittle solid. It is tailored by varying the ratio of resin to microspheres or macrospheres or a mix of both to provide the material properties and buoyancy required for the installation intended. The syntactic system is fluid and highly adhesive in the pre-cured condition which allows the syntactic material to fill all of the available volume of the external structure 10.

The exact formulation for the syntactic material must be determined empirically for each particular application. However, the following are example characteristics that may be desirable for the syntactic material used to form the add-on structure of the present invention for a submersible vessel:

Density=40 Pounds Per Cubic Foot

Bulk Modulus=215,000 PSI

Compressive Strength=2,700 PSI

Crush Pressure=4,500 PSI

Bonding Strength=10,000 PSI

Compressive Modulus=180,000 PSI

Water Absorption=(WT Gain=1.0%)

Figure 3:
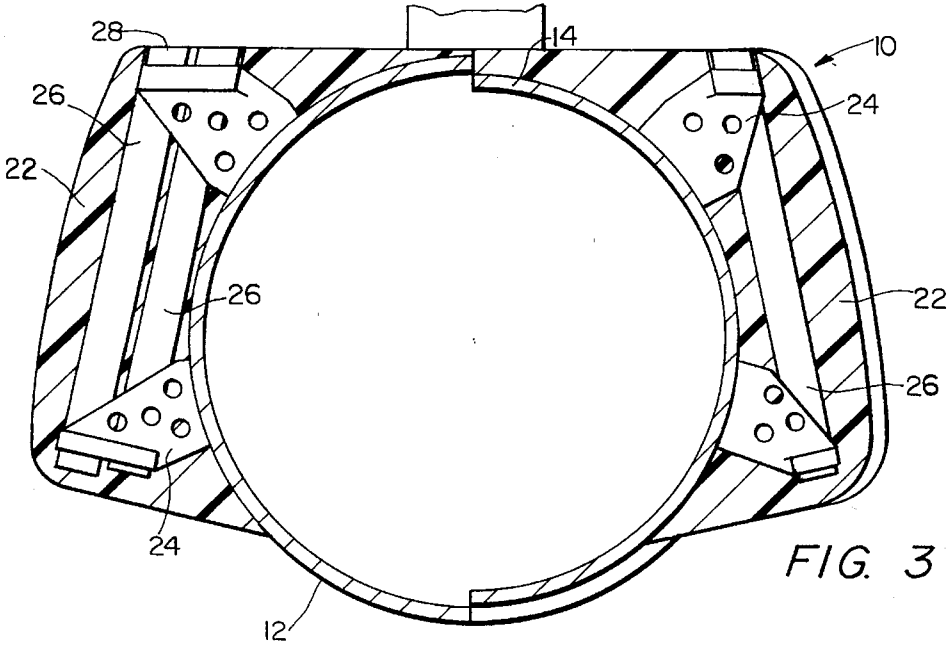
FIG. 3 is a partial cross-sectional view taken along the line 3—3 of FIG. 1.
Figure 4:
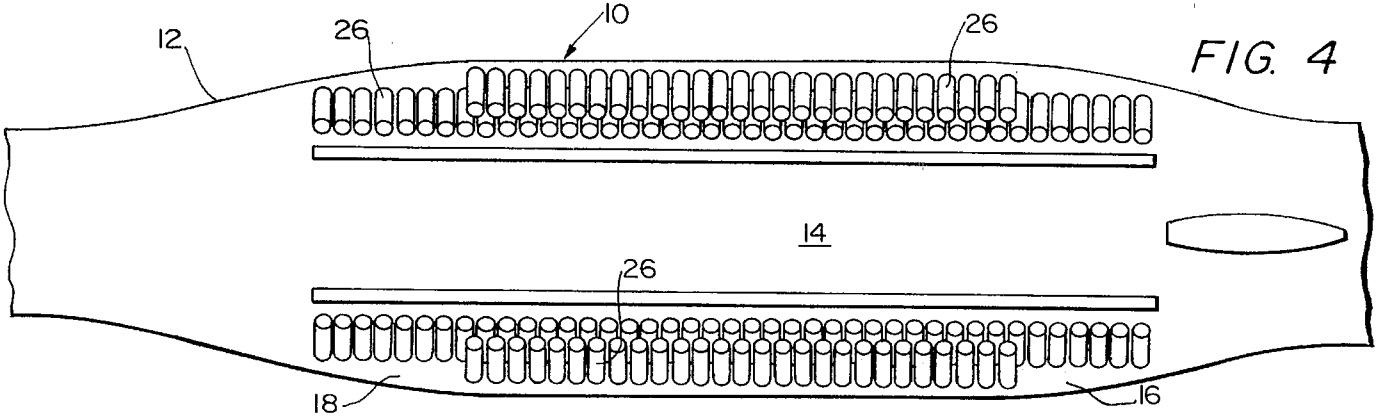
FIG. 4 is a top perspective view showing an embodiment with an arrangement of missile launch tubes carried in the externally mounted storage system of the present invention.

As previously discussed, the internal volume of the external structure 10 is occupied by syntactic material 22 and, as shown in FIG. 3, support for the external loads to be carried within structure 10. In the example shown in FIG. 3, the external form or mold 20 has been removed and the external skin of structure 10 is formed by syntactic material 22. As shown by example in Figure 3, the load to be carried in structure 10 may include steel foundations 24 that are welded or otherwise attached to hull 12. Foundations 24 may support missile launch tubes 26, for example. Launch tubes 26 are mounted in a vertical or nearly vertical configuration with their tops 28 flush with the upper surface of structure 10 and aligned with corresponding openings in structure 10 to allow missiles to be launched from structure 10. A large number of missile tubes can be accommodated in structure 10 by configuring a double row of tubes 26 in the larger section of structure 10 at the vessel's mid-body (left side of FIG. 3), and a single row of tubes 26 extending into the reduced, fairing member sections of structure 10 (right side of FIG. 3). This configuration can best be seen in FIG. 4. In its most lightweight form, the internal structure elements, if treated with mold release agents, can be removed after the syntactic material is cured. For example, the stowage tubes 26 could be removed leaving only a stowage cavity encapsulated entirely by syntactic material.

In a preferred embodiment, the volume bounded by exterior steel skin 20 (FIG. 2) and vessel hull 12, and around launch tubes 26 and tube foundation structures 24, is completely filled with a buoyant, rigid, and non-brittle urethane syntactic material. The syntactic material provides structural support to the steel skin 20, foundation structures 24 and launch tubes 26. The syntactic material also provides an additional attachment bond between the hull 12 and the foundation structures 24 and steel skin 20, and the buoyancy required to offset the added weight.

Another benefit of the use of syntactic foam in a submarine application is the ability to add buoyancy high, thus raising the submarine center of buoyancy relative to its center of gravity and increasing the surfaced and submerged stability of the submarine. An additional benefit is that by adding additional buoyancy over that required to support the added exterior load, additional margin lead can be placed aboard the submarine, thus re-establishing the design weight growth margin of the submarine.

Further, addition of the exterior structure with a urethane syntactic filling all of the void spaces within the exterior structure will have a beneficial impact upon two aspects of ship acoustics. The first aspect is the vessel's radiated signature. The large mass of partially compliant material bonded to the hull will reduce hull vibration propagating both longitudinally and radially along the hull by three mechanisms. First, by mass damping; the large mass bonded to the hull plating should shift the plating resonant frequency down toward zero HZ. Second, by acoustic absorption; the polyurethane component of the syntactic is a viscoelastic material and is somewhat compliant. Thus, acoustic energy passing from the hull through the syntactic will be attenuated due to conversion of acoustic (mechanical) energy to thermal energy within the syntactic. Third, by scattering; acoustic energy passing through the syntactic will impact multiple microspheres. These provide significant density changes which will break up the wave front into multiple wave fronts and reflect part of the energy back to the hull. Due to wavefront interaction and back reflection, the acoustic wavefront energy is reduced by diffraction and dispersion.

The second aspect of ship acoustics is the vessel's reflected signature. As discussed above, the added syntactic material will act to reduce an acoustic wavefront. An acoustic pulse from an active sonar is primarily reflected from an air/water interface at the inner surface of the pressure hull plating. This interface is shielded by the large mass of syntactic material which acts on the pulse moving toward the hull and the reflected pulse moving away from the hull. A significant reduction in reflected signature or target strength may be achieved.

From the foregoing detailed description, it will be evident that there are a number of changes, adaptations and modifications of the present invention which come within the province of those having ordinary skill in the art. However, it is intended that all such variations not departing from the spirit of the invention be considered as within the scope thereof, limited solely by the appended claims.

I claim:

1. An external storage system for a submarine having a hull comprising:

a storage means externally mounted to said submarine hull;

said external storage means being formed at least partly of syntactic material to provide structural support and compensating buoyancy;

said syntactic material being filled with at least one from a group of fillers including microspheres and macrospheres that are resistant to deformation under hydrostatic pressure and resistant to migration of water; and said external storage means including an external boundary formed at least partly of said syntactic material and configured as a fairing member of said submarine.

2. An external storage system as in claim 1 wherein said external storage means is formed on both sides of said vessel hull symmetrically disposed about a longitudinal axis of said vessel.

3. An external storage system as in claim 1 wherein said external storage means includes an external skin encompassing a portion of said syntactic material.

4. An external storage system as in claim 3 wherein said external skin is metal.

5. An external storage system as in claim 4 wherein said external skin is steel.

6. An external storage system as in claim 3 wherein said syntactic material is bonded to said external skin.

7. An external storage system as in claim 1 wherein said external storage means includes structural foundation members.

8. An external storage system as in claim 7 wherein said syntactic material is bonded to said structural foundation members.

9. An external storage system as in claim 1 wherein said external storage means includes missile launch tubes.

10. An external storage system as in claim 9 wherein said external storage means includes forward and aft fairing members, and including a double row of said launch tubes located at a midbody of said submarine, and including a single row of said launch tubes located within at least one of said forward and aft fairing members.

11. An external storage system as in claim 1 wherein said syntactic material is bonded to an exterior surface of said hull.

12. An external storage system as in claim 1 wherein said syntactic material is urethane resin based.

13. A method for mounting external loads to an exterior of a submarine having a hull, comprising:

attaching an external form to the outside of said hull of said submarine, wherein said form is configured as a fairing member of said submarine;

treating said external form with a mold releasing agent;

forming a syntactic material with at least one from a group of fillers including microspheres and macrospheres that are resistant to deformation under hydrostatic pressure and resistant to migration of water;

filling said form at least partially with syntactic material to provide structural support and compensating buoyancy for said external loads;

curing said syntactic material; and removing said form after said syntactic material is cured whereby said syntactic material forms at least a part of the external boundary of said submarine and said syntactic material is configured as a fairing member of said submarine.

14. A method for mounting external loads as in claim 13 further including attaching external support foundations to said hull.

15. A method for mounting external loads as in claim 14 further including filling said syntactic material around said support foundations.

16. A method for mounting external loads as in claim 14 further including attaching missile launch tubes to said support foundations.

17. A method for mounting external loads as in claim 16 further including filling said syntactic material around said launch tubes.

18. A method for mounting external loads as in claim 17 further including bonding said syntactic material to said hull, support foundations and launch tubes.

* * * * *